US007162815B2

(12) United States Patent
Miyauchi et al.

(10) Patent No.: US 7,162,815 B2
(45) Date of Patent: Jan. 16, 2007

(54) MIDSOLE STRUCTURE FOR AN ATHLETIC SHOE

(75) Inventors: Akihiro Miyauchi, Kawanishi (JP); Natsuki Sato, Mino (JP)

(73) Assignee: Mizuno Corporation, Osaka (JP)

( * ) Notice: Subject to any disclaimer, the term of this patent is extended or adjusted under 35 U.S.C. 154(b) by 256 days.

(21) Appl. No.: 10/815,886

(22) Filed: Mar. 31, 2004

(65) Prior Publication Data

US 2005/0217145 A1 Oct. 6, 2005

(51) Int. Cl.
*A43B 13/16* (2006.01)

(52) U.S. Cl. ..... 36/103; 36/30 R; 36/28; 36/31; 36/50.1

(58) Field of Classification Search ..... 36/31, 36/30 R, 102, 103, 99, 145, 148, 141, 50.1
See application file for complete search history.

(56) References Cited

U.S. PATENT DOCUMENTS

| | | | | |
|---|---|---|---|---|
| 6,219,939 | B1 * | 4/2001 | Kita et al. | 36/28 |
| 6,289,608 | B1 | 9/2001 | Kita et al. | |
| 6,295,741 | B1 * | 10/2001 | Kita | 36/30 R |
| 6,311,414 | B1 * | 11/2001 | Kita | 36/28 |
| 6,389,713 | B1 * | 5/2002 | Kita | 36/30 R |
| 6,497,058 | B1 * | 12/2002 | Dietrich et al. | 36/69 |
| 6,625,905 | B1 * | 9/2003 | Kita | 36/30 R |
| 6,685,011 | B1 * | 2/2004 | Nishiwaki et al. | 36/28 |
| 6,775,930 | B1 * | 8/2004 | Fuerst | 36/103 |
| 6,983,553 | B1 * | 1/2006 | Lussier et al. | 36/28 |
| 2003/0009915 | A1 * | 1/2003 | Bacon | 36/44 |

FOREIGN PATENT DOCUMENTS

| | | |
|---|---|---|
| JP | 11-203 | 1/1999 |
| JP | 2001-8704 | 1/2001 |
| JP | 2003339406 | 12/2003 |

* cited by examiner

*Primary Examiner*—Jila M. Mohandesi
(74) *Attorney, Agent, or Firm*—W. F. Fasse; W. G. Fasse

(57) ABSTRACT

A midsole structure for an athletic shoe includes an upper midsole (3) formed of a soft elastic material, a lower midsole (4) disposed under the upper midsole (3) and formed of a soft elastic material, and a wavy plate assembly (5) interposed between the upper midsole (3) and the lower midsole (4). The wavy plate assembly (5) includes a wavy board (50) and a pair of sidewall members (51) provided discretely from the wavy board (50) and disposed on opposite Bides of the wavy board (50). Each of the sidewall members (51) includes a wavy bottom portion (51*b*) overlapping the wavy board (50) and an upraised portion (51*a*) extending upwardly from the wavy bottom portion (51*b*) to face a side surface of the upper midsole (3). Provision of the wavy board (50) and the sidewall members (51) discretely from each other simplifies a layout of a mold for forming the wavy plate assembly (5), thereby reducing a manufacturing cost.

15 Claims, 7 Drawing Sheets

MIDSOLE STRUCTURE FOR AN ATHLETIC SHOE

BACKGROUND OF THE INVENTION

The present invention relates to a midsole structure for an athletic shoe or a sports shoe, and more particularly, to an improvement in a wavy, corrugated plate structure having a wavy, corrugated plate disposed at a midsole formed of a soft elastic material.

Japanese patent application publication No. 11-203 describes a midsole structure having a wavy, corrugated plate in use for various sports shoes. Such a midsole structure is composed of an upper midsole formed of a soft elastic material, a lower midsole disposed under the upper midsole and formed of a soft elastic material, and a wavy, corrugated plate interposed therebetween.

In such a structure, the upper and lower midsole secures cushioning properties on landing and the wavy, corrugated plate prevents lateral deformation of the midsole after landing, thereby achieving running stability.

On the other hand, there exists a need to prevent lateral deformation of the midsole more securely to achieve advanced running stability in sports such as tennis, basket ball, or the like where hard lateral movements are required. Such being the case, as shown in Japanese patent application publication No. 2001-8704, there is provided a wavy, corrugated plate with sidewalls extending upwardly and downwardly on opposite side edges thereof and disposed on opposite side surfaces of the midsole.

In this structure, when the upper and lower midsole is going to deform in a lateral direction after landing, the sidewalls of the wavy, corrugated plate restrain deformation of the upper and lower midsoles.

However, since such a wavy, corrugated plate with sidewalls is formed of a wavy board and a pair of side walls formed integrally with opposite side edges of the wavy board, a layout of molds for forming a wavy, corrugated plate becomes complicated, thus making a manufacturing cost higher.

The present invention has been made in view of these circumstances and its object is to reduce manufacturing cost of a wavy, corrugated plate structure with sidewalls in use for a sports shoe.

SUMMARY OF THE INVENTION

A midsole structure for an athletic shoe of the present invention includes a midsole formed of a soft elastic material and a wavy plate assembly disposed at the midsole. The wavy plate assembly is comprised of a wavy board that is provided on the lower surface of the midsole and a sidewall member that is provided discretely from the wavy board and that has a wavy bottom portion overlapping the wavy board and an upraised portion extending upwardly from the wavy bottom portion to face a side surface of the midsole.

According to the present invention, because the sidewall member is provided discretely from the wavy board, that is, the sidewall member is not integrally formed with the wavy board, each forming process of the wavy board and sidewall member can be conducted separately from each other, thereby facilitating a layout of forming molds and reducing a manufacturing cost.

Moreover, by varying properly an overlapping extent of the wavy bottom portion of the sidewall member with the wavy board, the midsole structure of the current invention can be applied to various shoes of different sole widths. That is, in this case, a wavy board and sidewall member of a single kind can correspond to various sole widths.

Furthermore, in the invention, because each mold for forming the wavy board and sidewall member can be provided separately from each other, the extent of the upraised portion of the sidewall member can be increased with ease. To the contrary, in the event that a mold for a sidewall member is integrated with a mold for a wavy board, it is not easy to increase the extent of the upraised portion of the sidewall member due to its mold structure. By enlarging the extent of the upraised portion, lateral deformation of the midsole on landing can be more securely prevented.

The midsole structure may further include a second midsole, which is disposed under the first midsole. The wavy plate assembly is interposed between the first upper midsole and the second lower midsole.

Another wavy board may be provided on the upper surface of the second lower midsole. In this case, a double wavy board structure is achieved for enhanced running stability.

The sidewall member may be provided on either side of opposite ends of the wavy board. On the other side of the wavy board, an upraised portion is integrally formed with the wavy board.

The sidewall member maybe provided on both sides of the wavy board. In this case, since the wavy board is formed of a simple wavy plate, a layout of a mold for forming the wavy board is further simplified. Thereby, a manufacturing cost is further reduced. Also, in this case, each of a pair of sidewall members on opposite sides of the wavy board has a wavy bottom portion that overlaps the wavy board, respectively. Therefore, by varying an overlapping extent of each wavy bottom portion, the midsole structure can be applied to wide ranges of sole sizes.

The sidewall member may include a downwardly extending portion that faces a side surface of the second lower midsole. In this case, lateral deformation of the second lower midsole can also be restrained, thereby preventing lateral deformation of the entire midsole more securely.

The sidewall member may be formed of a different material than the wavy board.

The upraised portion of the sidewall member may be formed with a slit for engaging an end of a strap, which wraps around an upper of a shoe.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
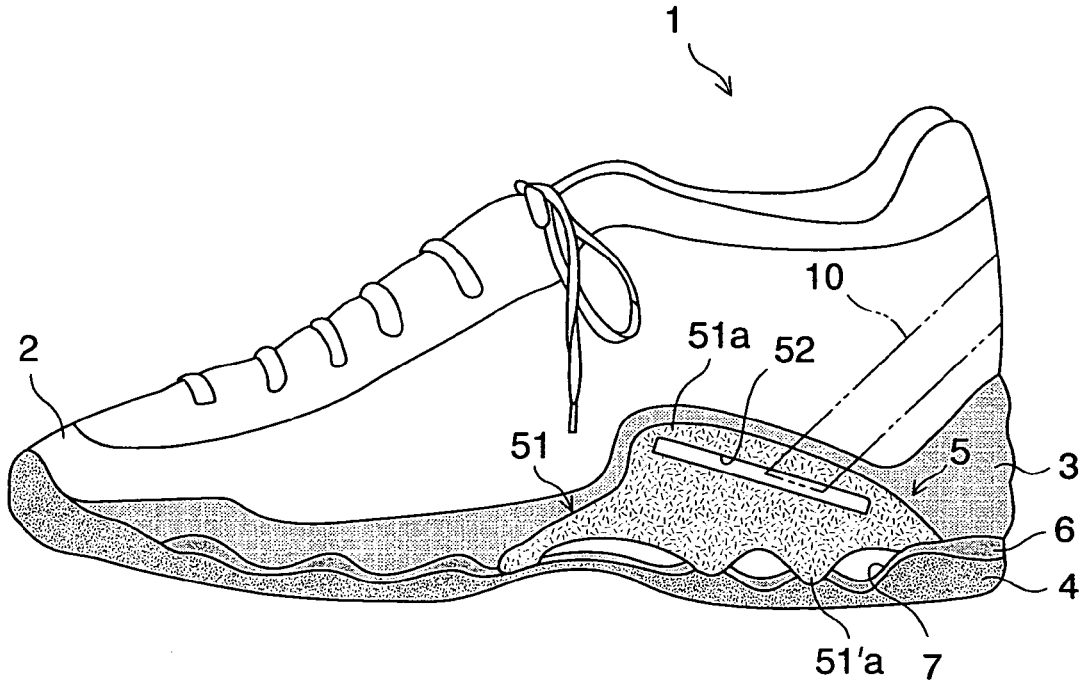
FIG. 1 is a side view of an athletic shoe incorporating a midsole structure according to an embodiment of the present invention.

FIG. 1 shows an athletic shoe incorporating a midsole structure of the present invention. As shown in FIG. 1, the midsole structure of shoe 1 is composed of an upper midsole 3, a lower midsole 4 disposed under the upper midsole 3, and a wavy plate assembly 5 interposed between the upper and lower midsole 3, 4. A wavy plate 6 is also provided under the wavy plate assembly 5 between the upper and lower midsole 3, 4. A plurality of cushion holes 7 are formed between the wavy plate assembly 5 and the wavy plate 6.

Figure 2:
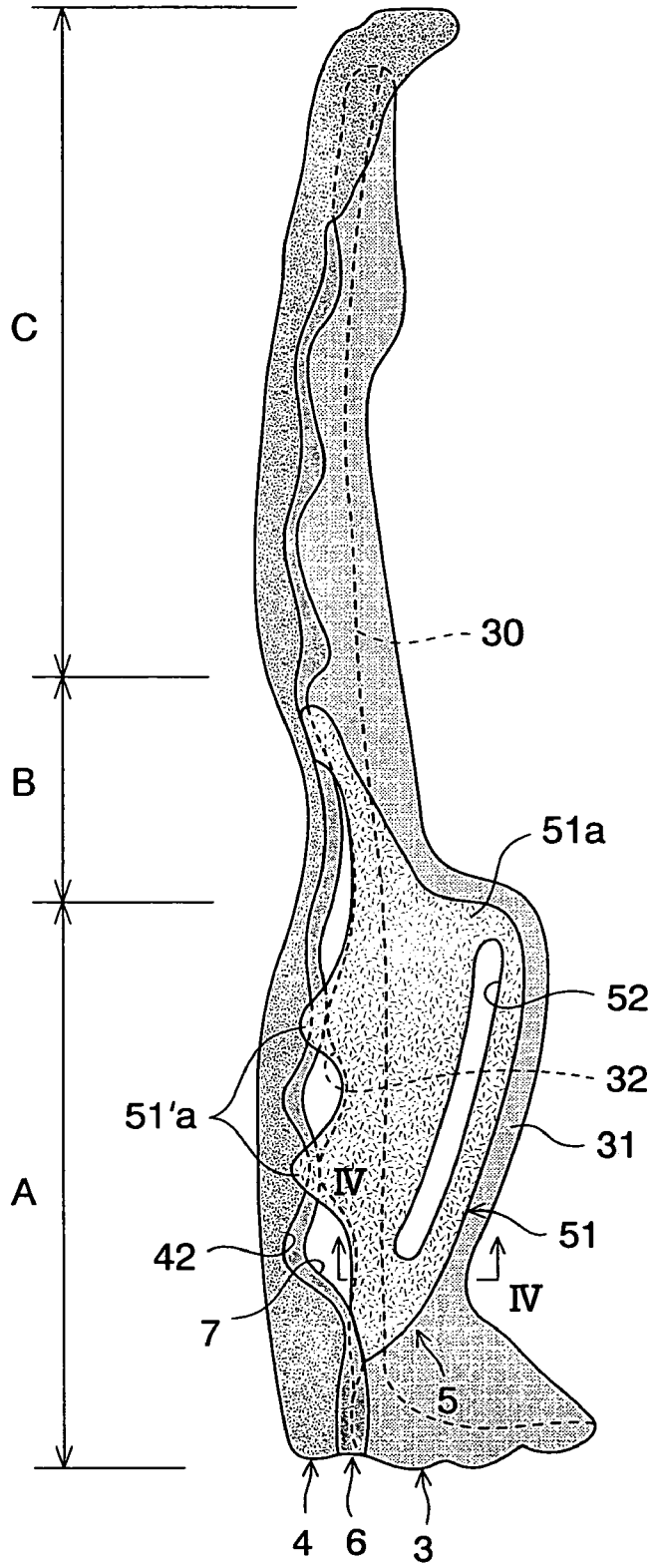
FIG. 2 is an enlarged side view of the midsole structure of FIG. 1.
Figure 3:
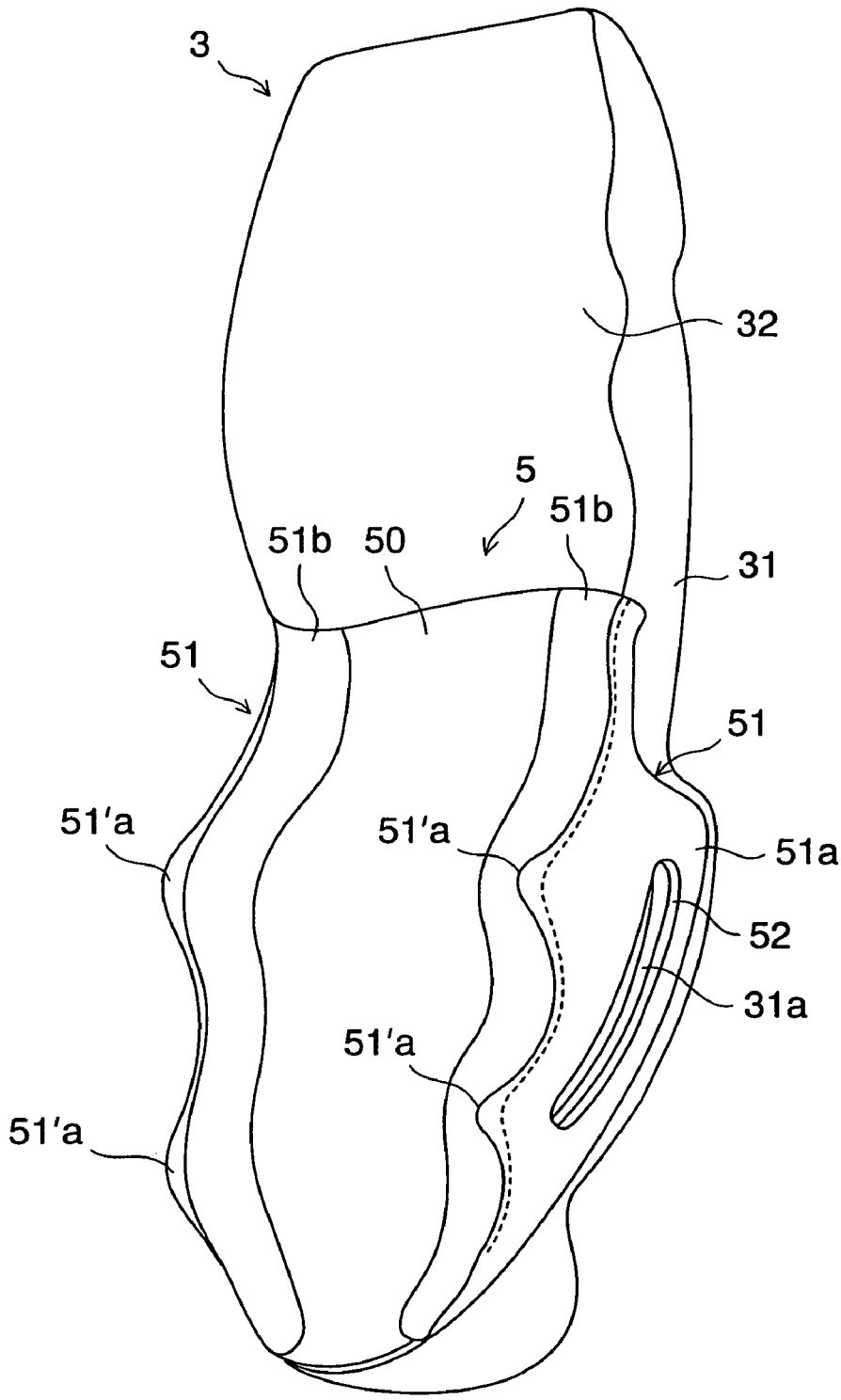
FIG. 3 is a perspective view of an upper midsole and a wavy plate assembly of the midsole structure of FIG. 1, viewed from the bottom side.
Figure 4:
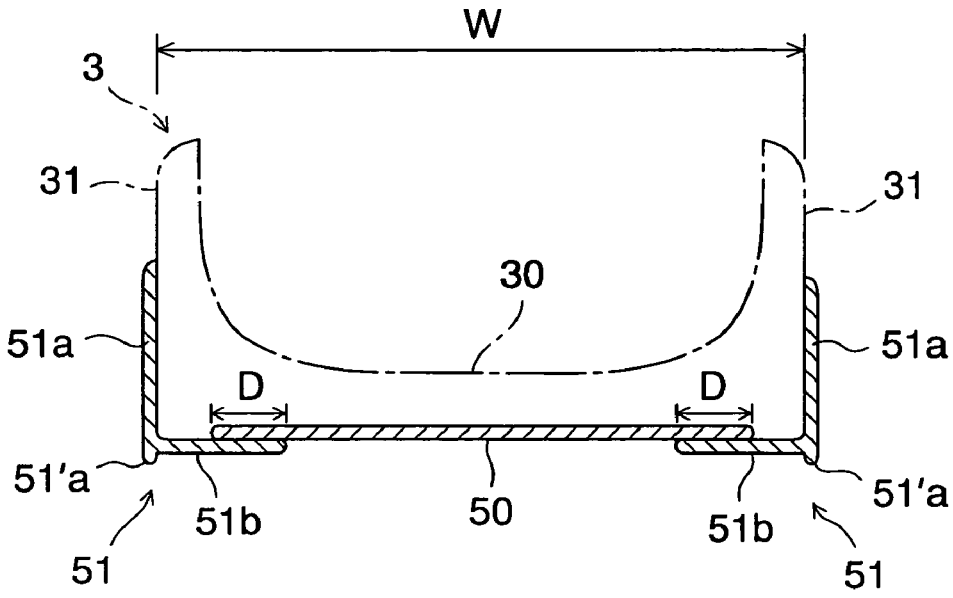
FIG. 4 is a cross sectional view of FIG. 2 taken along line IV—IV.

FIGS. 2–4 illustrate details of the midsole structure. As shown in these drawings, the upper midsole 3 extends from a shoe's heel region A to a forefoot region C via a midfoot or a plantar arch region B. The upper midsole 3 includes a base surface 30 on which a lower portion of an upper 2 is attached and a pair of upraised walls 31 extending upwardly from opposite sides of the base surface 30. The upper midsole 3 has a wavy surface 32 on its lower surface, which extends from heel region A to forefoot region C.

The lower midsole 4 extends from heel region A to forefoot region C via midfoot or plantar arch region B. The lower midsole 4 has a wavy surface 42 on its upper surface, which extends from heel region A to forefoot region C.

The upper and lower midsoles 3, 4 are generally formed of a soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber is used.

The wavy plate assembly 5 extends from heel region A to midfoot or plantar arch region B and is composed of a wavy board 50 and a pair of sidewall members 51 disposed on opposite sides of the wavy board 50 and provided discretely from the wavy board 50.

The wavy board 50 is disposed and attached on a lower wavy surface 32 of the upper midsole 3 and has a wavy corrugation that corresponds to the lower wavy surface 32. Each of the sidewall members 51 includes a wavy bottom portion 51*b* overlapping with and disposed under the wavy board 50 and an upraised portion 51*a* extending upwardly from the wavy bottom portion 51*b* along a side surface of the upper midsole 3. The wavy bottom portion 51*b* supports a lower wavy surface of the wavy board 50.

The upraised portion 51*a* faces and contacts the upraised wall 31 of the upper midsole 3 to securely restrain lateral deformation of the upper midsole 3 after landing.

The upraised portion 51*a* has a slit 52 and the upraised wall 31 has a slit 31*a* that is formed at a position corresponding to slit 52. These slits 52, 31*a* are provided for engaging an end of a strap 10 that wraps around a heel rear end portion of the upper 2 of the shoe, as shown in FIG. 1. The other end of the strap 10 may be detachably attached to an instep portion of the upper 2 via a hook-and-loop fastener. Alternatively, one end of the strap 10 maybe interposed between and connected to the base surface 30 of the upper midsole 3 and an insole (not shown) provided on the base surface 30. In this case, the strap 10 extends through the slits 52, 31*a*, and the other end may be detachably attached to an instep portion of the upper 2 via a hook-and-loop fastener. By tightening the strap 10, the upper midsole 3 is pulled upwardly toward a foot of a shoe wearer, thus improving fittability of the heel portion of the shoe.

The sidewall member 51 has a downwardly extending portion 51'*a* that depends from the wavy bottom portion 51*b* to face a side surface of the lower midsole 4. The portion 51'*a* restrains lateral deformation of the lower midsole 4 after landing.

The wavy plate assembly 5 may be formed of thermoplastic resin such as thermoplastic polyurethane (TPU) of comparatively rich elasticity, polyamide elastomer (PAE), ABS resin, ethylene-vinyl acetate copolymer (EVA) or the like. Alternatively, the wavy plate assembly 5 may be formed of thermosetting resin such as epoxy resin, unsaturated polyester resin and the like.

The wavy board 50 and the sidewall member 51 are not necessarily formed of the same material and may be formed of different materials. For example, the wavy board 50 may be formed of a material of a relatively small modulus of elasticity and the sidewall member may be formed of a material of a relatively large modulus of elasticity.

As above-mentioned, the sidewall member 51 is provided discretely from the wavy board 50, thus facilitating the use of different materials for both the sidewall member 51 and the wavy board 50. In contrast, in the event that the wavy board 50 and the sidewall member 51 are integrally formed with each other, it is not easy to form them from different materials.

Also, by providing the sidewall member 51 discretely from the wavy board 50, they are separately resin-molded using different forming molds. Thereby, a layout of the molds becomes easy and a manufacturing cost is reduced. In addition, when molding the upper midsole 3 the wavy board 50 may be inserted into the mold, thereby forming the wavy board 50 integrally with the upper midsole 3.

Moreover, since the sidewall member 51 is disposed on opposite sides of the wavy board 50, the wavy board 50 is a simple wavy plate, which makes a layout of a forming mold for the wavy board 50 much simpler and reduces a further manufacturing cost.

Furthermore, by providing the sidewall member 51 discretely from the wavy board 50 and using separate molds for molding them, it becomes easy to increase the extent of the upraised portion 51*a*. In contrast, in the event that a mold for the wavy board 50 is integrated with a mold for the sidewall member 51, it is not easy to increase the extent of the upraised portion 51*a* due to the mold structure. Increase in the extent of the upraised portion 51*a* prevents lateral deformation of the upper midsole 3 more firmly.

Figure 5:
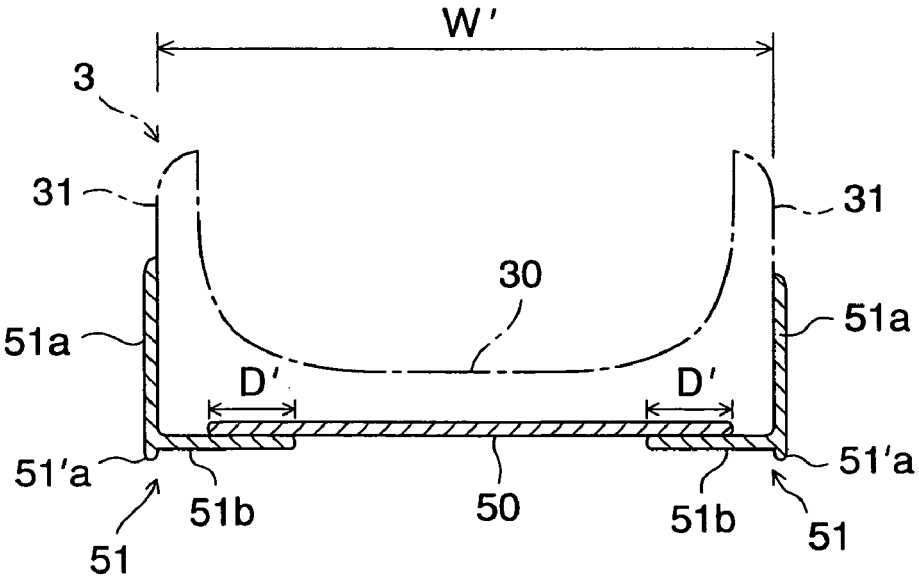
FIG. 5 corresponds to a cross sectional view of FIG. 2 taken along line IV—IV, illustrating the effect of the present invention.

As is clearly seen in FIG. 4, the wavy bottom portion 51*b* of the sidewall member 51 overlaps opposite sides of the wavy board 50. The extent of an overlap is D and sole width is W. As shown in FIG. 5, when the extent of the overlap is changed to D' (>D) by moving the sidewall member 51 laterally outwardly, sole width is changed to W' (<W).

In such a manner, by varying properly an overlapping extent of the wavy bottom portion 51*b* of the sidewall member 51 with the wavy board 50, the sole structure can be applied to various shoes of different sole widths. That is, in this case, a wavy board and sidewall member of a single kind can correspond to various sole widths.

Moreover, in this case, since each of the wavy bottom portions 51*b* of the sidewall members 51 on opposite sides of the wavy board 50 overlaps the wavy board 50, respectively, the midsole structure can be applied to wide ranges of sole widths by varying each overlapping extent on each side of the wavy board 50.

Figure 6:
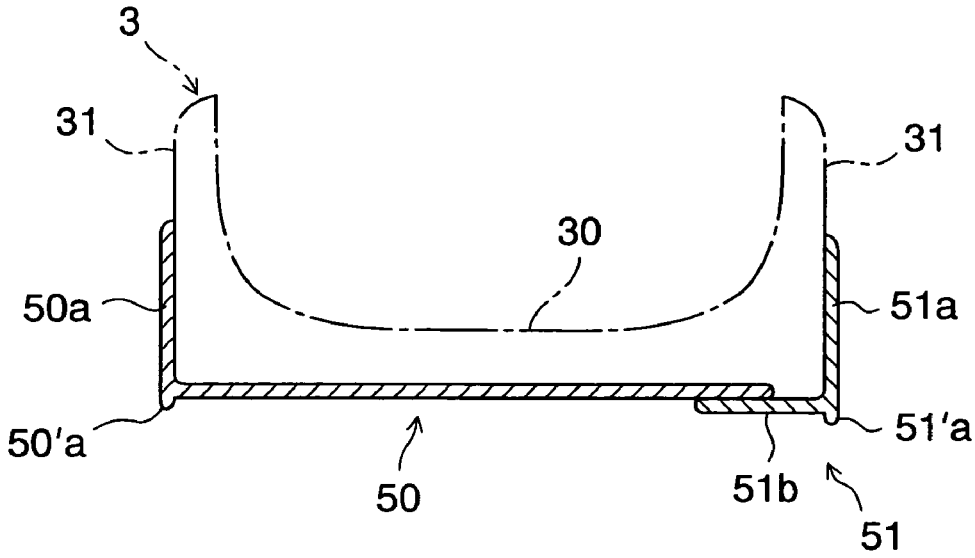
FIG. 6 shows a variant of FIG.4.

In addition, as shown in FIG. 6, the sidewall member 51 may be provided on one side of the wavy board 50. In this case, on the other side of the wavy board 50, an upraised portion 50*a* and a downwardly depending portion 50'*a* are integrally formed with the wavy board 50.

Figure 7:
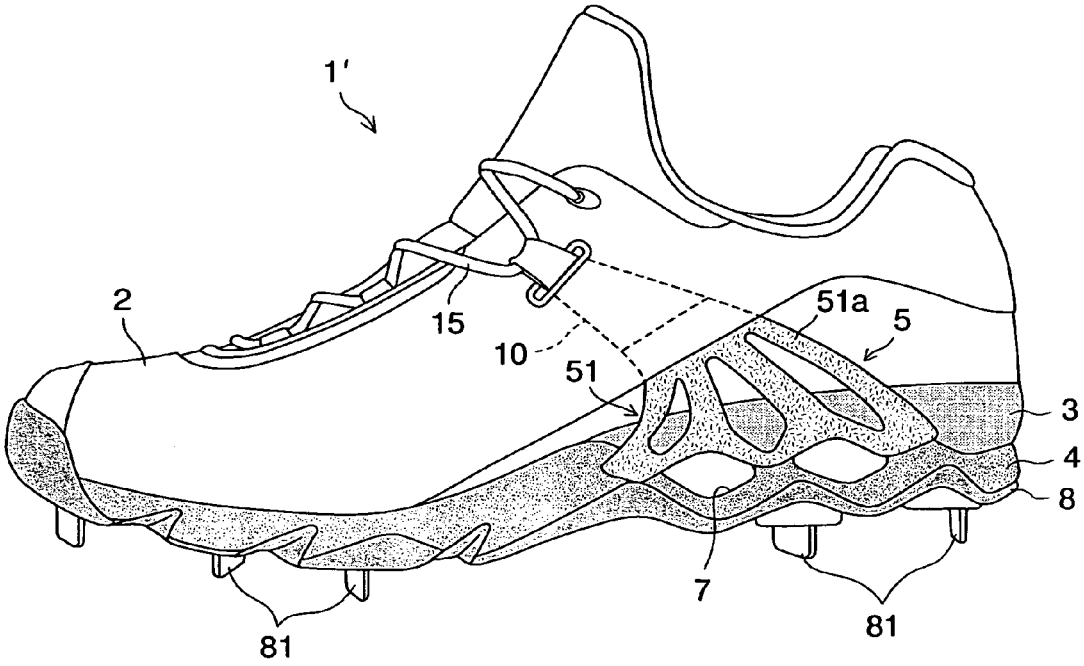
FIG. 7 is a side view of an athletic shoe incorporating a midsole structure according to another embodiment of the present invention.

FIG. 7 shows an athletic shoe incorporating a midsole structure according to another embodiment of the present invention. Like reference numbers indicate identical or functionally similar elements.

In the midsole structure shown in FIG. 7, similar to the embodiment of FIG. 1, wavy plate assembly 5 is interposed between upper midsole 3 and lower midsole 4. However, in this case, the upper midsole 3 is disposed only at the heel region. Also, an outsole 8 is disposed under the lower midsole 4. The outsole 8 and the lower midsole 4 extend from the heel region to the forefoot region. A plurality of cleats 81 are provided on the outsole 8.

In the same manner as the embodiment of FIG. 1, the wavy plate assembly 5 is composed of a wavy board (not shown) disposed on the upper midsole 3 and a pair of sidewall members 51 disposed on opposite sides of and provided discretely from the wavy board. Each of the sidewall members 51 includes a wavy bottom portion (not shown) overlapping with and disposed under the wavy board and an upraised portion 51*a* extending upwardly from the wavy bottom portion along a side surface of the upper midsole 3.

Unlike the embodiment of FIG. 1, one end of strap 10 is fastened to the distal end of the upraised portion 51*a* of the sidewall member. The strap 10 extends toward the instep portion of the upper 2 and its distal end is connected to a shoelace 15. When tightening the strap 10, the heel portion of the upper midsole 3 is pulled toward the instep of the upper 2. However, in this case, the wavy board has corrugations that restrain lateral upward deformation of the wavy board. Thereby, tightening force of the strap 10 is securely transmitted to the instep portion of the upper 2, thus achieving fittability of the shoe.

Additionally, in FIG. 7, upper midsole 3 may extend from the heel region to the forefoot region and the lower midsole 4 may be disposed only at the heel region.

Figure 8:
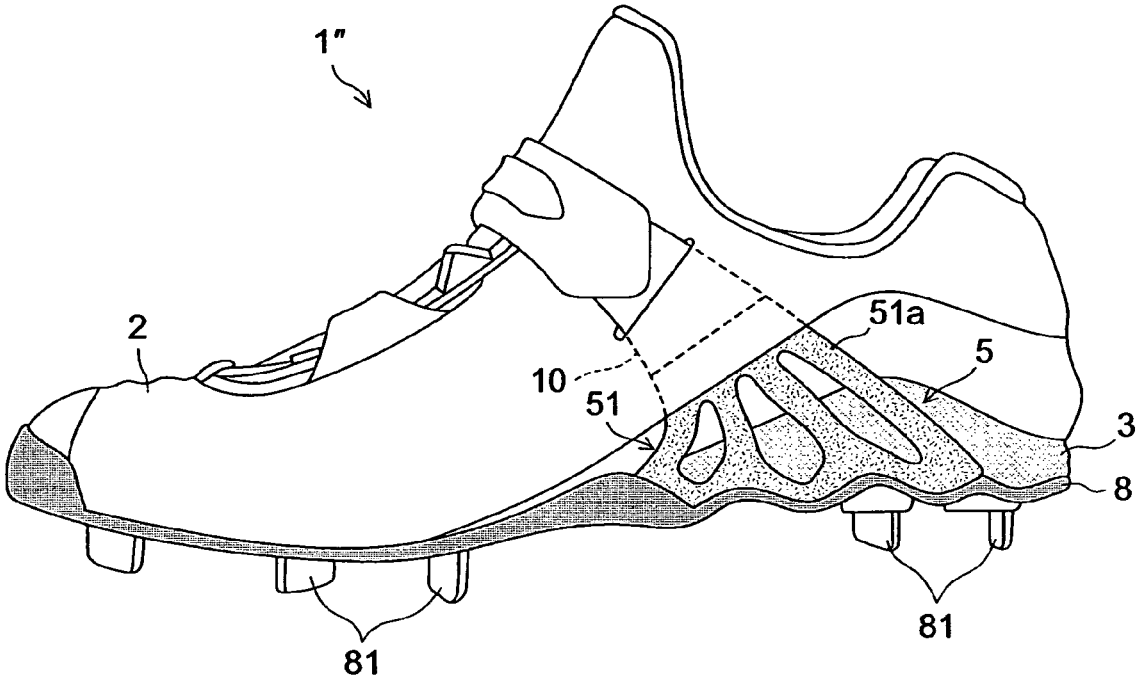
FIG. 8 is a side view of an athletic shoe incorporating a midsole structure according to yet another embodiment of the present invention.

FIG. 8 shows an athletic shoe incorporating a midsole structure according to yet another embodiment of the present invention. Like reference numbers indicate identical or functionally similar elements.

In the midsole structure shown in FIG. 8, similar to the embodiment of FIG. 7, wavy plate assembly 5 is disposed under the midsole 3, but in this case, lower midsole is not provided. Outsole 8 is directly attached on the wavy plate assembly 5 and upper 2.

In the same manner as the embodiment of FIG. 7, the wavy plate assembly 5 is composed of a wavy board (not shown) disposed on the midsole 3 and a pair of sidewall members 51 disposed on opposite sides of and provided discretely from the wavy board. Each of the sidewall members 51 includes a wavy bottom portion (not shown) overlapping with and disposed under the wavy board and an upraised portion 51*a* extending upwardly from the wavy bottom portion along a side surface of the midsole 3. One end of strap 10 is fastened to the distal end of the upraised portion 51*a* of the sidewall member and the strap 10 extends toward the instep portion of the upper 2.

Unlike the embodiment of FIG. 7, the strap 10 has a hook-and-loop fastener on its distal end. The distal end of the strap 10 on one side is detachably fastened to the distal end of the strap 10 on the other side via hook-and-loop fasteners.

As with the embodiment of FIG. 7, when tightening the strap 10, the heel portion of the midsole 3 is pulled toward the instep of the upper 2. However, in this case, the wavy board has corrugations that restrain lateral upward deformation of the wavy board. Thereby, tightening force of the strap 10 is securely transmitted to the instep portion of the upper 2, thus achieving fittability of the shoe.

Additionally, in FIG. 8, midsole 3 may extend from the heel region to the forefoot region.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A midsole structure for an athletic shoe comprising:

a first midsole formed of a soft elastic material; and a wavy plate assembly;

wherein said wavy plate assembly comprises a wavy board disposed on a lower surface of said first midsole, and a sidewall member, wherein said sidewall member is provided discretely from said wavy board, and wherein said sidewall member includes a wavy bottom portion disposed at and laterally overlapping only a laterally-limited side edge portion of said wavy board adjoining a first side edge of said wavy board, and an upraised portion extending upwardly from said wavy bottom portion to face a side surface of said first midsole.

2. A midsole structure of claim 1, wherein said wavy bottom portion is disposed under said wavy board to support a lower surface of said wavy board.

3. A midsole structure of claim 1, wherein said midsole structure further includes a second midsole, which is disposed under said first midsole, and said wavy plate assembly is interposed between said first midsole and said second midsole.

4. A midsole structure of claim 3, further comprising a second wavy board interposed between said first midsole and said second midsole, said second wavy board being disposed under said wavy plate assembly.

5. A midsole structure of claim 1, wherein said sidewall member is provided on one side of opposite sides of said wavy board and, on the other side of the opposite sides of said wavy board, an upraised portion is integrally formed with said wavy board.

6. A midsole structure of claim 1, further comprising another said sidewall member, wherein said sidewall members are respectively disposed on opposite sides of said wavy board.

7. A midsole structure of claim 3, wherein said sidewall member includes a downwardly extending portion that faces a side surface of said second midsole.

8. A midsole structure of claim 1, wherein said sidewall member is formed of a different material than the wavy board.

9. A midsole structure of claim 1, wherein said upraised portion of said sidewall member is adapted to engage a strap that wraps around an upper of the shoe.

10. A midsole structure of claim 9, wherein said strap wraps around a heel rear end portion of said upper.

11. A midsole structure of claim 9, wherein said strap wraps around an instep portion of said upper.

12. A midsole structure of claim 1, wherein said wavy board extends continuously laterally under said first midsole.

13. A midsole structure of claim 1, wherein said sidewall member has an L-shaped cross sectional shape formed by said upraised portion and said wavy bottom portion.

14. A midsole structure of claim 4, wherein said second a wavy board has second wavy corrugations located relative to first wavy corrugations of said wavy board of said wavy plate assembly so as to form voids therebetween.

15. A midsole structure for an athletic shoe comprising:

a midsole formed of a soft elastic material; and a wavy plate assembly disposed at said midsole;

wherein:

said wavy plate assembly is composed of a wavy board disposed on a lower surface of said midsole and a sidewall member provided discretely from said wavy board, said sidewall member includes a wavy bottom portion overlapping said wavy board and an upraised portion extending upwardly from said wavy bottom portion to face a side surface of said midsole, and said upraised portion of said sidewall member is adapted to engage a strap that wraps around an upper of the shoe.

* * * * *

UNITED STATES PATENT AND TRADEMARK OFFICE

CERTIFICATE OF CORRECTION

PATENT NO. : 7,162,815 B2
APPLICATION NO. : 10/815886
DATED : January 16, 2007
INVENTOR(S) : Miyauchi et al.

It is certified that error appears in the above-identified patent and that said Letters Patent is hereby corrected as shown below:

Title page,
Item [57], ABSTRACT,
Line 8, after "opposite", replace "Bides" by --sides--;

Column 2,
Line 25, after "member", replace "maybe" by --may be--;

Column 7,
Line 17, after "second" delete "a".

Signed and Sealed this

Twenty-sixth Day of June, 2007

JON W. DUDAS
*Director of the United States Patent and Trademark Office*